US006338293B1

(12) United States Patent
Johnson et al.

(10) Patent No.: US 6,338,293 B1
(45) Date of Patent: Jan. 15, 2002

(54) REDUCED OIL VOLUME PISTON ASSEMBLY FOR A HYDROSTATIC UNIT

(75) Inventors: Alan W. Johnson, Ames, IA (US); Kenneth J. Woodshank, Monroe, WI (US); Michael A. Betz, Huxley; Richard L. Otto, Marshalltown, both of IA (US)

(73) Assignee: Sauer-Danfoss Inc., Ames, IA (US)

( * ) Notice: Subject to any disclaimer, the term of this patent is extended or adjusted under 35 U.S.C. 154(b) by 0 days.

(21) Appl. No.: 09/607,303

(22) Filed: Jun. 30, 2000

(51) Int. Cl.[7] ..... F01B 3/00; F01B 31/00
(52) U.S. Cl. ..... 92/71; 92/135
(58) Field of Search ..... 92/71, 135

(56) References Cited

U.S. PATENT DOCUMENTS

| | | | | |
|---|---|---|---|---|
| 3,187,644 A | | 6/1965 | Ricketts | 92/248 |
| 3,707,113 A | | 12/1972 | Hein et al. | 92/248 |
| 3,896,707 A | | 7/1975 | Holmstrom | 92/172 |
| 3,915,074 A | | 10/1975 | Bristow et al. | 92/172 |
| 3,984,904 A | | 10/1976 | Schlecht | 29/156.5 R |
| 3,986,439 A | | 10/1976 | Ring | 92/158 |
| 3,999,468 A | | 12/1976 | Bristow et al. | 92/248 |
| 4,494,448 A | | 1/1985 | Eystratov et al. | 92/172 |
| 4,519,300 A | | 5/1985 | Adomis, Jr. et al. | 92/158 |
| 4,898,077 A | * | 2/1990 | McBeth | 91/505 |
| 5,007,332 A | | 4/1991 | Wagenseil | 92/181 |
| 5,072,655 A | | 12/1991 | Adler | 91/160 |
| 5,076,148 A | | 12/1991 | Adler | 92/158 |
| 5,216,493 A | | 6/1993 | Adler et al. | 92/157 |
| 5,490,446 A | | 2/1996 | Engel | 92/157 |

* cited by examiner

*Primary Examiner*—Edward K. Look
*Assistant Examiner*—Michael Leslie
(74) *Attorney, Agent, or Firm*—Zarley, McKee, Thomte, Voorhees & Sease P.

(57) ABSTRACT

A reduced oil volume piston assembly for a hydrostatic unit includes a piston assembly having a piston body and a stem formed separately from the piston body. A cavity is formed in one end of the piston body. The stem includes an enlarged head and an elongated neck extending upwardly from the head. The neck lossely inserts into the cavity of the piston body so as to at least partially fill the cavity. The head is unattached to the piston body and cannot enter the cavity, but its shape allows fluid flow into the cavity around the stem. These components can be incorporated into the cylinder block assembly as separate components or the stems can be integrally cast with the cylinder block or attached thereto as a stem ring assembly.

18 Claims, 6 Drawing Sheets

REDUCED OIL VOLUME PISTON ASSEMBLY FOR A HYDROSTATIC UNIT

BACKGROUND OF THE INVENTION

The present invention relates to the field of hydrostatic units such as transmissions, pumps and motors. More particularly, this invention relates to means for reducing the oil volume of pistons slidably mounted in the cylinder block bores of hydrostatic units.

The oil volume in each piston bore is compressed to the operating pressure of the hydrostatic unit at some time during each rotation of the cylinder block. The fact that oil is compressible and takes energy to compress results in energy losses for units that do not have solid or sealed pistons. It is known in the hydrostatic art to utilize solid pistons to improve efficiency. However, solid pistons are relatively heavy, which reduces the maximum speed at which they can operate due to higher block tipping forces and higher centrifugal forces that cause piston burn as the pistons reciprocate longitudinally in the piston bores.

It is also known in the hydrostatic art that the oil-containing volume of a piston can be reduced by forming the piston with a hollow or cavity therein, then sealing the cavity so oil cannot enter. This is conventionally done by welding a cap member on the hollow piston body. Unfortunately, such welded pistons are generally costly to produce. Direct displacement (non-servo) units typically do not utilize pistons with conventionally reduced oil-containing volume because of the higher cost. Another problem with hollow welded pistons lies in the variation in control moments that occurs with changes in the rotational speed of the cylinder block. Since direct displacement units do not have a servo to control the swashplate, the operator feels the control moments to a greater degree and therefore experiences greater operator fatigue.

Therefore, a primary objective of the present invention is the provision of a reduced oil volume piston and cylinder block assembly that improves the efficiency of a hydrostatic unit without unduly increasing its cost.

Another objective of the present invention is the provision of a piston and cylinder block assembly wherein the filler material for the piston is retained in the cylinder block, rather than in the piston, so that the filler material has no impact on the centrifugal forces on the piston and causes no additional block tipping forces.

Another objective of the present invention is the provision of a reduced volume piston and cylinder block assembly that is economical to produce, as well as reliable and durable in use.

These and other objectives will be apparent to one skilled in the art from the drawings, as well as from the following description and claims.

SUMMARY OF THE INVENTION

The present invention relates to piston and cylinder block assemblies for hydrostatic units. These assemblies reduce the oil volume of the pistons. The reduced oil volume piston and cylinder block assembly includes a cylinder block with a central bore and a plurality of cylindrical piston bores radially spaced from the central bore, a plurality of pistons having one hollow end slidably mounted in the piston bores, and a plurality of stems correspondingly disposed in the piston bores and extending into the cavity at the hollow end of the pistons so as to displace or reduce the oil-containing capacity or volume of the piston.

The stem of this invention is formed separately from the piston body, as described below in three different embodiments. In the first embodiment, the stem is a separate component that is inserted in each piston bore. In the second embodiment, the stems are cast as an integral part of the cylinder block. In the third embodiment, the stems extend into the pistons because the stems are attached to a ring that is fixed to the bottom of the cylinder block.

DETAILED DESCRIPTION OF THE PREFERRED EMBODIMENTS

Figure 1:
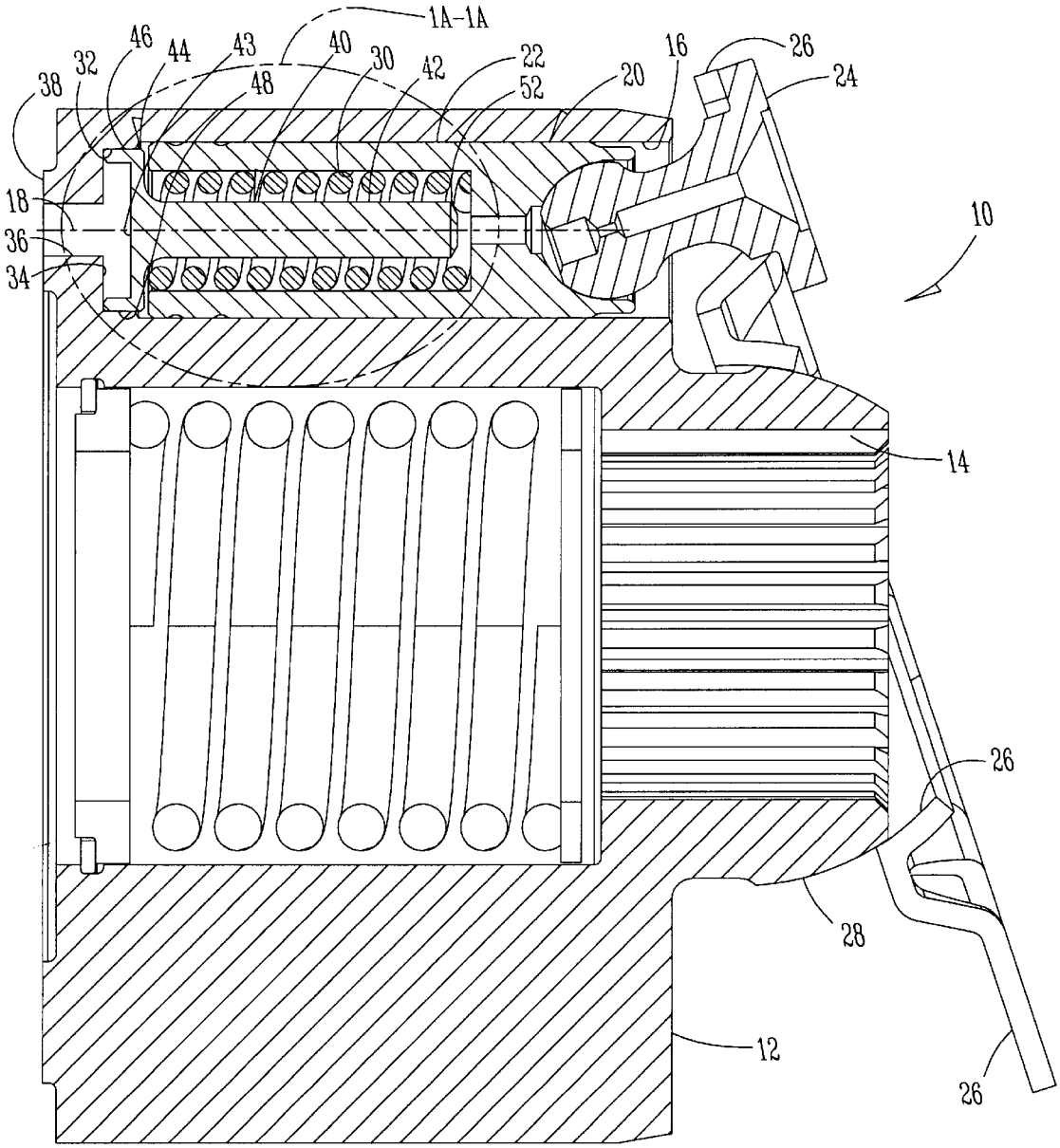
FIG. 1 is a cross sectional view of a first embodiment of the present invention.
Figure 2:
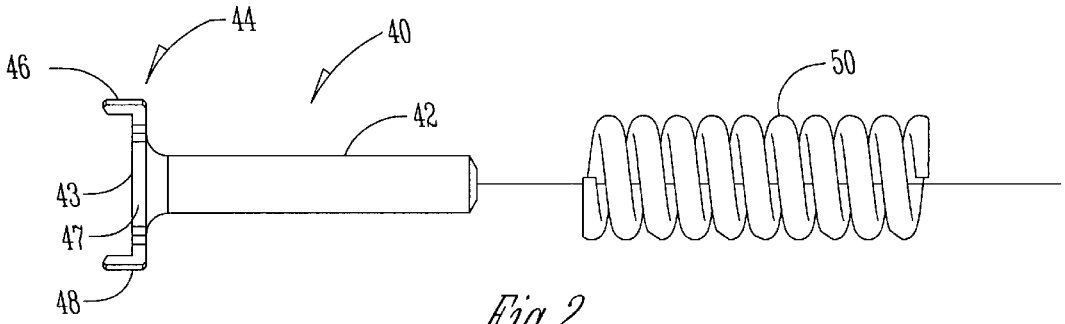
FIG. 2 is an exploded assembly view of the stem and piston return spring shown in FIG. 1.

In the figures and the description that follows, like reference numerals are used to refer to like parts and features. The first embodiment of the invention is shown in FIGS. 1 and 2. Referring to FIG. 1, a piston and cylinder block assembly 10 includes a central bore 14 extending therethrough and a plurality of cylindrical piston bores 16 radially spaced from the central bore 14 and equally spaced angularly around the central bore 14. Each of the piston bores 16 has a central longitudinal axis 18.

The piston and cylinder block assembly 10 further includes a plurality of piston assemblies 20 that include a piston 22 with a slipper 24 pivotally attached by a ball and socket connection. While the drawings show the socket incorporated in the upper end of the piston 22, one skilled in the art will appreciate that a ball end can be provided on the piston and the socket incorporated into the slipper without detracting from the present invention. As is conventional, a slipper retainer guide 26 tiltingly supports the slippers 24 on a spherical central hub surface 28 of the cylinder block 12.

The body of the piston 22 is elongated and cylindrical. The end of the piston opposite that which is connected to the slipper 24 has a cavity 30 formed therein. Preferably, the cavity 30 is defined by cylindrical bore that extends into the body of the piston 22.

Figure 1A:
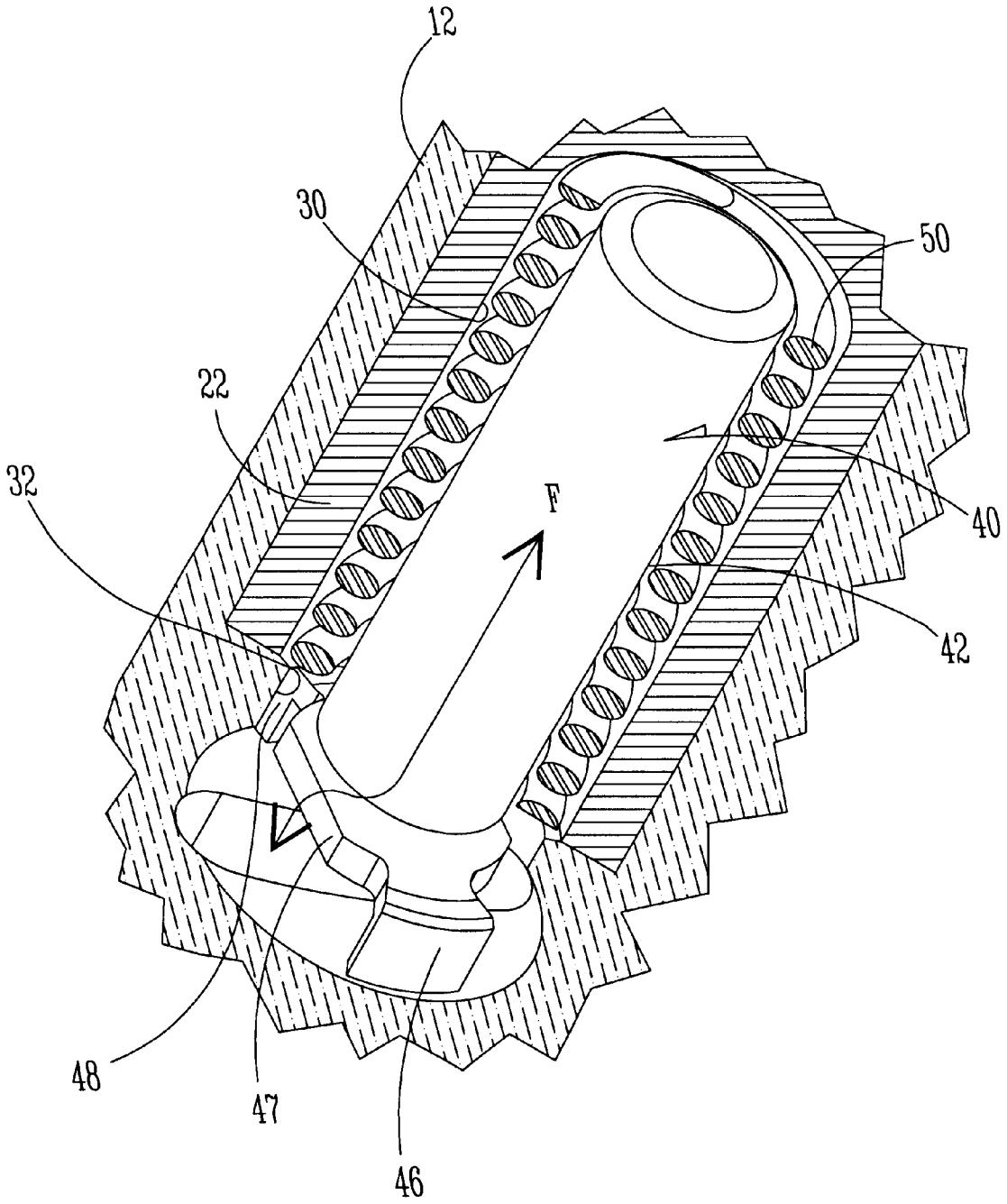
FIG. 1A is partial sectional view taken of the area 1A—1A in FIG. 1 and shows how fluid can flow around the bottom of the stem of this invention.

The portion of the piston bore 16 that slidably receives the piston 22, does not extend all the way through the cylinder block 12. Instead, a reduced diameter bore 32 and a bottom wall 34 are present below the main piston bore 16. As is conventional, arcuate ports 36 are provided on a bottom "running" surface 38 on the cylinder block 12. As best understood in view of F in FIGS. 1A, 3A, and 5, the ports or fluid passages 36 are in fluid communication with the piston bores 16.

A stem 40 is formed separately from the block 12 and the pistons 22. The stem 40 is adapted to be inserted into the piston bore 16 prior to or in conjunction with the insertion of the piston assembly 20 into the cylinder block 12. Referring to FIG. 2, the stem 40 is a rigid and solid elongated member that includes a neck 42 and a head 44. The head 44 is enlarged with respect to the diameter of the neck 42. In the embodiment of FIGS. 1 and 2, the neck 42 of the stem 40 is cylindrical. However, other shapes will suffice for the invention, realizing that the oil volume displaced will differ as a result of their shape. The cylindrical shaped neck 42 is preferred because of the high volume of oil that displaces from the hollow piston 22 and the ease with which it can be manufactured.

The head 44 is shaped so as to partially cover the opening of the cavity 30 without completely covering it when the stem 40 is inserted into the cavity. The head 44 has a plurality of spaced flange members 46, 48 thereon protruding radially outward and downward from the neck 42. Each of the flange members 46, 48 has an L-shaped longitudinal cross section and an arcuate transverse cross section. Preferably, the head has a maximum dimension across the flanges 46, 48 (i.e.—in a direction transverse to the neck 42 and thereby to the piston 22) that is less than the outer diameter of the piston 22 and is adapted to be received in the reduced diameter bore 32. The maximum dimension across the flanges 46, 48 is also larger than the diameter of the cavity 30, as shown in FIG. 1, so that the head 44 cannot enter the cavity 30 of the piston 22.

The neck 42 has a bottom end 43. The flange members 46, 48 attach to the bottom end 43 of the neck 42 and protrude outward and downward therefrom. Each of the flange members 46, 48 has an L-shaped longitudinal cross section and an arcuate transverse cross section. Thus, a gap is provided under and around the bottom end 43 of the stem 42 so that fluid can pass by the stem 40. As best seen in FIG. 2, the flanges 46, 48 also are angularly spaced. Notches or flats 47 are formed in the outer perimeter of the head 44 between the flanges 46, 48, thereby leaving gaps that allow fluid to pass in and out of the piston bores 16 as the pistons 22 reciprocate. See FIG. 1A.

The piston assembly 20 further includes a spring 50. The spring 50 is preferably a coiled compression spring, which has an inner diameter sufficient to pass over the neck 43 of the stem 40 and an outer diameter adapted to be loosely received in the cavity 30 of the piston 22. Thus, the spring 50 can be coiled around the neck of the stem 42 and positioned between the end wall 52 of the cavity 30 and the head 44 of the stem 40. In the hydrostatic art such a spring is generally referred to as a piston return spring, however, in this invention the spring 50 performs another important function. The force of the spring 50 holds the stem 40 in place in the cylinder block 12 as the piston 22 reciprocates. The spring force effectively locks the stem 40 to the block 12 so that it does not move relative to the block.

There are two possible methods for assembling the piston and cylinder block assembly 10 of FIGS. 1 and 2. One way is to place the spring 50 over the stem 40 and insert these two items into the cavity 30 of the piston 22. Then, the block 12 can be placed over the above-mentioned components. This method requires a special fixture to align all of the piston assemblies 20 with their respective piston bores 16. A second and more preferred method of assembling the components is to drop stems 40 into the reduced diameter bores 32 through the piston bores 16. Then, the springs 50 are installed over the neck 42 of the stem 40. The upper surface of the head 44 serves as seat for the spring 50. Then, the remainder of the piston assembly 20 is guided over the springs 50 in the piston bores 16. Preferably, the piston assemblies 20 are inserted in the slipper retainer guide 26, which assists in simultaneously aligning the piston assemblies 20 with their respective piston bores 16.

Figure 3:
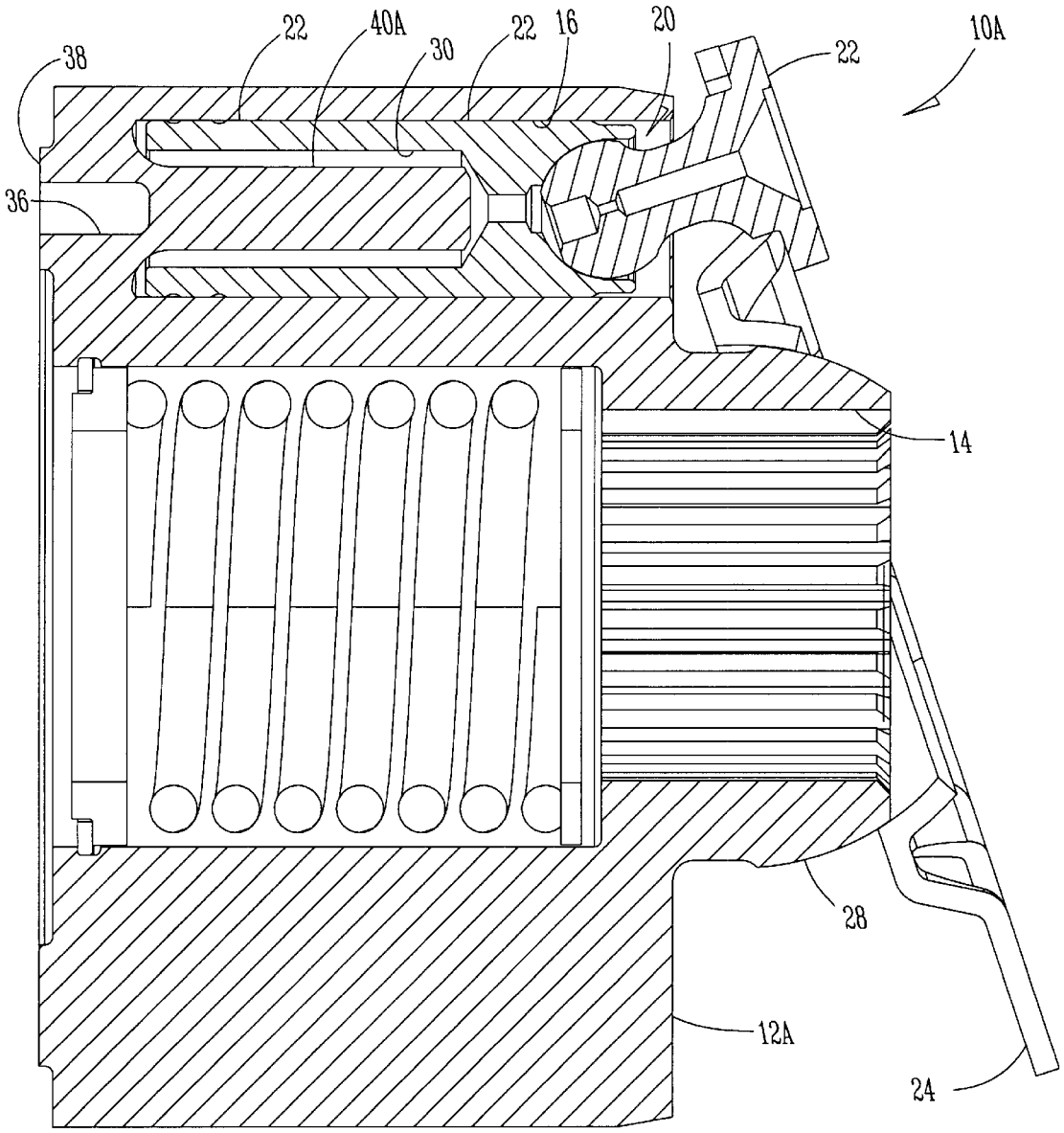
FIG. 3 is a cross sectional view of a second embodiment of this invention in which the stem is integrally cast into the cylinder block.
Figure 3A:
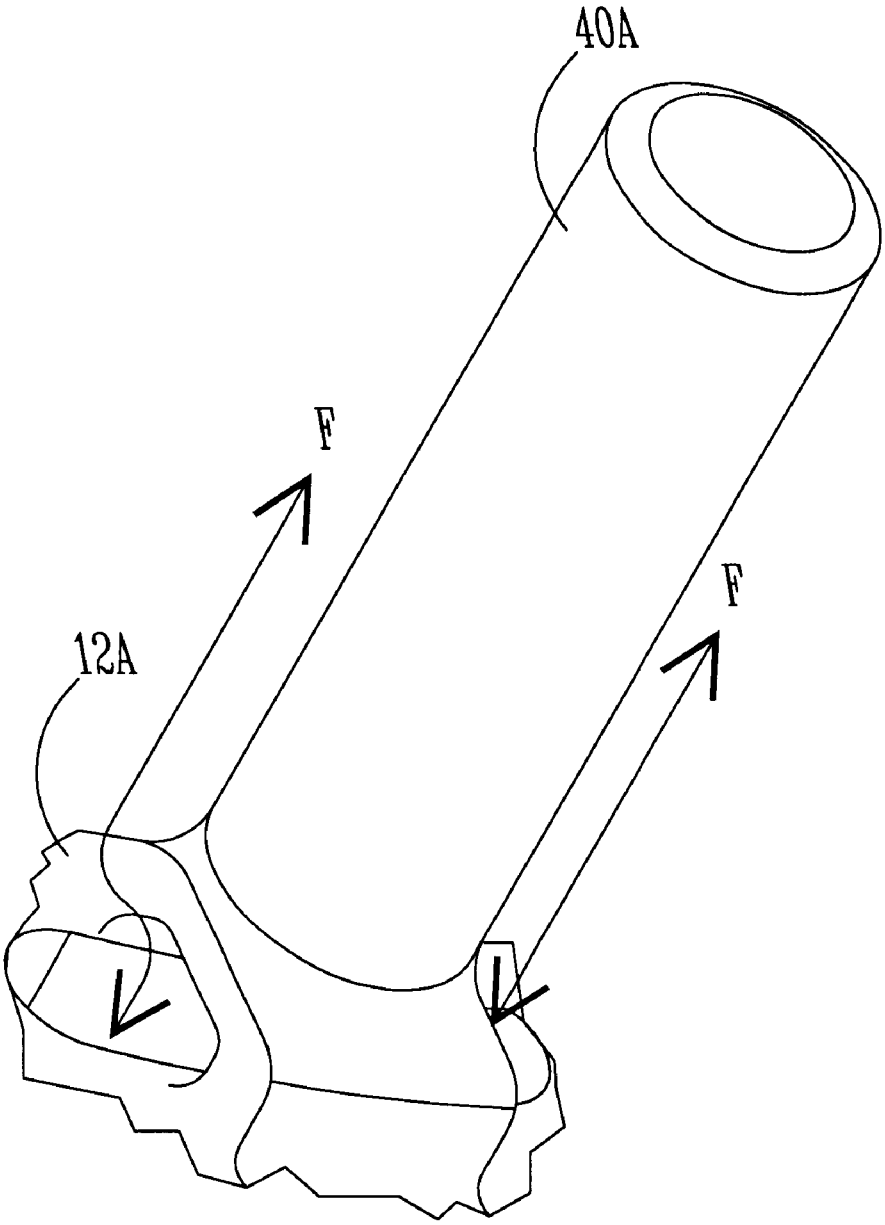
FIG. 3A is a partial perspective view of the stem area of the cylinder block of FIG. 3.

A second embodiment of the invention 10A is shown in FIG. 3 and 3A. The cylinder block 12A of this embodiment is formed in a conventional "lost foam" casting process such that the stem 40A is integrally formed with the cylinder block 12A as a single piece casting. The cast cylinder block is then conventionally machined so as to finish the piston bore and the other features, while leaving the central post of neck 42A of the stem 40A. Thus, in this embodiment, the filler material that displaces or reduces the oil volume in the piston cavity 30 is integrally attached to the block 12A. The cost of this embodiment is low and the reliability is high. Attaching the filler material to the cylinder block 12A has no impact on the centrifugal forces on the piston 22 and does not add to the block tipping forces because it does not extend out of the cylinder block 12A with the pistons 22.

Figure 4:
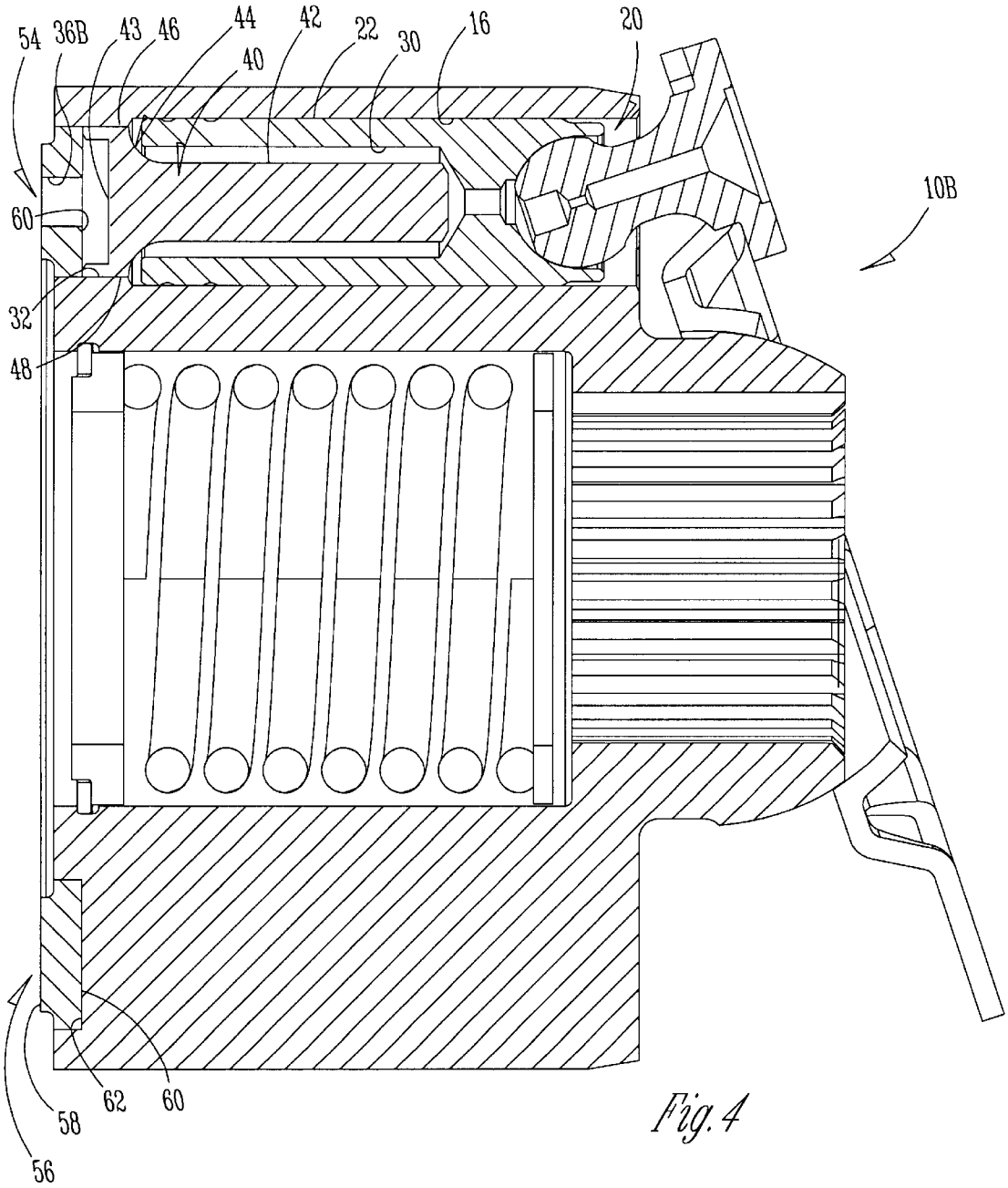
FIG. 4 is a cross sectional view of a third embodiment of this invention in which a separate stem ring assembly is fixed to the bottom of the cylinder block.
Figure 5:
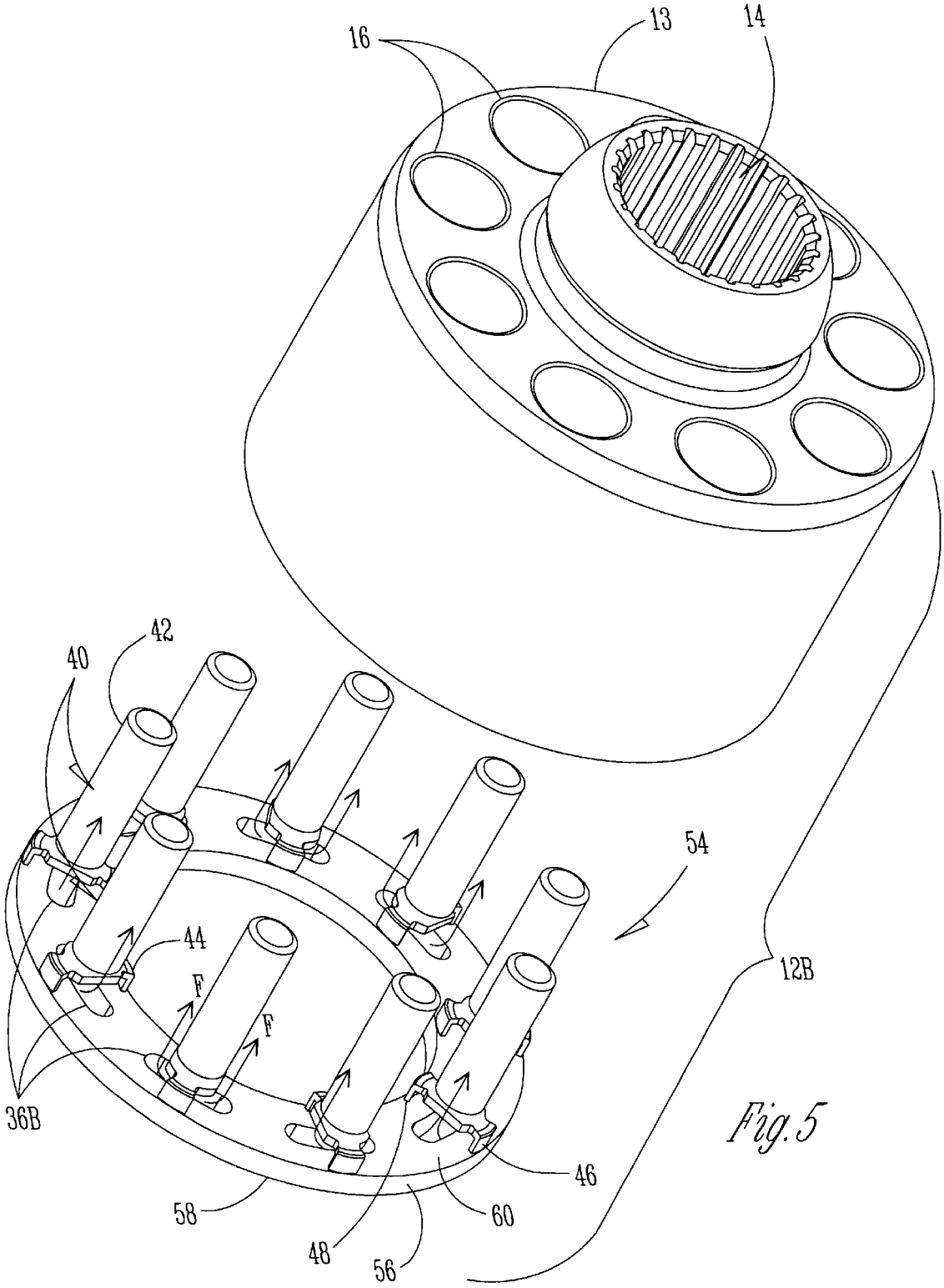
FIG. 5 is an exploded assembly view of the stem ring assembly and cylinder block of the embodiment shown in FIG. 4.

FIGS. 4 and 5 illustrate a third embodiment of this invention. The piston and cylinder block assembly 10B of this embodiment includes a main block 13, a central opening 14 and a plurality of piston bores 16. A stem ring assembly 54 includes an annular base plate 56 having a plurality of arcuate ports 36B extending therethrough. The base plate 56 has a lower or "running" surface 58 and an upper surface 60. The stems 40 are rigidly attached to the upper surface 60 of the base plate 56, preferably extending at right angles thereto. The flanges 46, 48 bridge the arcuate ports 36B and a gap exists between the bottom end 43 of the neck 42 and the upper surface 60, as best seen in FIG. 5.

An annular groove 62 is formed in the bottom surface of the main block 13. The groove 62 has a width that is the same as the reduced diameter bore 32 in the main block 13. The groove 62 is concentric with the central bore 14 and registers with each of the piston bores 16.

To make the cylinder block 12B of this embodiment, the stem ring assembly is fabricated first as a separate component. The stems 40 on the stem ring assembly 54 are aligned with the piston bores 16 and the base plate 56 is inserted into the groove 62. Then, the base plate 56 is braised or otherwise rigidly attached or affixed to the bottom of the main block 13. The lower surface 58 of the base plate 56 acts as the running surface for the cylinder block 12B.

Thus, it can be seen that the present invention at least achieves its stated objectives.

What is claimed is:

1. A piston assembly having reduced oil volume comprising:

a piston body including opposite ends, one of the ends having a cavity formed therein and an opening into the cavity thereon; and a stem formed separately from piston body and including a head and a solid elongated neck extending upwardly therefrom;

the neck being loosely inserted into the cavity of the piston body so as to at least partially fill the cavity without completely filling the cavity;

the head being enlarged with respect to the neck and shaped so as to partially cover the opening of the cavity without completely covering the opening when the stem is inserted into the cavity.

2. The assembly of claim 1 wherein the cavity is defined by a cylindrical bore in the piston body.

3. The assembly of claim 2 wherein the neck of the stem is cylindrical.

4. The assembly of claim 1 wherein the head has a plurality of spaced flange members thereon protruding radially outward and downward from the neck.

5. The assembly of claim 4 wherein each of the flange members has an L-shaped longitudinal cross section and an arcuate transverse cross section.

6. The assembly of claim 1 wherein the head has an outer perimeter with at least one notch formed thereon to permit fluid to flow into and out of the cavity.

7. The assembly of claim 1 wherein the cavity has an end wall and a spring is coiled around the neck of the stem and positioned between the bottom wall and the head of the stem.

8. The assembly of claim 7 wherein the head has an upper surface adjacent the neck and extending radially outward therefrom to form a seat for the spring.

9. A reduced oil volume piston and cylinder block assembly comprising:

a cylinder block having a central bore extending therethrough and a plurality of cylindrical piston bores therein radially spaced from the central bore, each of the piston bores having a longitudinal axis;

a plurality of pistons slidably mounted respectively in the piston bores, each of the pistons having opposite ends with one of the ends having a cavity of a predetermined volume; and a plurality of solid-necked stems on the cylinder block extending into the piston bores respectively; whereby each of the stems displaces a portion of the predetermined volume and thereby leaves a remaining volume available to be filled with oil that is less than the predetermined volume.

10. The assembly of claim 9 wherein the cylinder block includes a main block including a bottom surface extending generally transverse to the central bore, and a separate stem ring assembly attached to the bottom surface; the stem ring assembly including an annular base plate having upper and lower surfaces, the stems having a base portion attached to the base plate and extending upwardly from the upper surface of the base plate so as to protrude into the piston bores when the stem ring assembly is fixed to the bottom surface of the cylinder block, fluid passages being formed through the base plate and registered with the piston bores so as to be in fluid communication therewith.

11. The assembly of claim 10 wherein the stem includes an elongated neck and the base portion of the stem includes a head that protrudes radially outward and downward from the neck.

12. The assembly of claim 11 wherein the neck of the stem is cylindrical.

13. The assembly of claim 11 wherein the neck has a bottom end and the head has a plurality of spaced flange members thereon attached to the bottom end of the neck and protruding radially outward and downward therefrom, the flange members each having an upper end attached to the neck and a lower end rigidly fixed to the base plate such that a gap exists between the bottom end of the neck and the base plate for fluid to flow through.

14. The assembly of claim 13 wherein each of the flange members has an L-shaped longitudinal cross section and an arcuate transverse cross section.

15. The assembly of claim 11 wherein the piston body is an elongated cylinder that has an outer diameter and the cavity is cylindrical so as to define an inner diameter of the piston body, and wherein the head has a maximum dimension in a direction transverse to the neck and piston body that is greater than the inner diameter of the piston body and less than the outer diameter of the piston body.

16. The assembly of claim 10 wherein the main block has an annular groove formed in the bottom surface thereof, the groove being concentric to the central bore and in communication with each of the piston bores, the annular groove matingly receiving the annular base plate to mount the stem ring assembly to the main block.

17. The assembly of claim 16 wherein the base plate is braised to the main block.

18. A reduced oil volume piston and cylinder block assembly comprising:

a cylinder block having a central bore extending therethrough and a plurality of cylindrical piston bores therein radially spaced from the central bore, each of the piston bores having a longitudinal axis;

a plurality of pistons slidably mounted respectively in the piston bores, each of the pistons having opposite ends with one of the ends having a cavity of a predetermined volume; and a plurality of stems on the cylinder block extending into the piston bores respectively; whereby each of the stems displaces a portion of the predetermined volume and thereby leaves a remaining volume available to be filled with oil that is less than the predetermined volume;

wherein the stems are integrally formed with the cylinder block as a single piece casting.

* * * * *